US011409320B2

(12) United States Patent
Griffey

(10) Patent No.: US 11,409,320 B2
(45) Date of Patent: Aug. 9, 2022

(54) SYSTEM AND METHOD FOR PROVIDING HAPTIC FEEDBACK TO AN OPERATOR OF A WORK VEHICLE BASED ON A COMPONENT OF THE VEHICLE BEING CONTROLLED

(71) Applicant: CNH Industrial America LLC, New Holland, PA (US)

(72) Inventor: Larry Bruce Griffey, Elgin, IL (US)

(73) Assignee: CNH Industrial America LLC, New Holland, PA (US)

( * ) Notice: Subject to any disclaimer, the term of this patent is extended or adjusted under 35 U.S.C. 154(b) by 624 days.

(21) Appl. No.: 16/401,840

(22) Filed: May 2, 2019

(65) Prior Publication Data

US 2020/0348713 A1 Nov. 5, 2020

(51) Int. Cl.

| | |
|---|---|
| ***G05G 5/03*** | (2008.04) |
| ***E02F 9/20*** | (2006.01) |
| ***G05G 9/047*** | (2006.01) |

(52) U.S. Cl.

CPC ..... *G05G 5/03* (2013.01); *E02F 9/2004* (2013.01); *G05G 9/047* (2013.01); *G05G 2009/04766* (2013.01)

(58) Field of Classification Search

None

See application file for complete search history.

(56) References Cited

U.S. PATENT DOCUMENTS

| | | | | |
|---|---|---|---|---|
| 8,972,120 | B2 | 3/2015 | Linstroth | |
| 9,206,587 | B2 | 12/2015 | Linstroth | |
| 9,745,721 | B2 | 8/2017 | Linstroth | |
| 9,836,077 | B2 | 12/2017 | Smith | |
| 2013/0229272 | A1 * | 9/2013 | Elliott | G05G 9/047 340/407.2 |
| 2014/0338235 | A1 | 11/2014 | Ryan | |

FOREIGN PATENT DOCUMENTS

| | | | | |
|---|---|---|---|---|
| FR | 3056202 | A1 * | 3/2018 | B66F 11/044 |

* cited by examiner

*Primary Examiner* — Vicky A Johnson

(74) *Attorney, Agent, or Firm* — Peter Zacharias; Peter Sheldrake

(57) ABSTRACT

In one aspect, a system for providing haptic feedback to an operator of a work vehicle may include an operator control device and a controller. The controller may be configured to identify one of a first component of the work vehicle or a second component of the work vehicle as a selected component to be controlled via the operator control device. Furthermore, the controller may be configured to control the operation of the operator control device such that the operator control device provides a first haptic response to the operator when first component is identified as the selected component. Additionally, the controller may be configured to control the operation of the operator control device such that the operator control device provides a second haptic response to the operator when second component is identified as the selected component, with the second haptic response differing from the first haptic response.

16 Claims, 6 Drawing Sheets

SYSTEM AND METHOD FOR PROVIDING HAPTIC FEEDBACK TO AN OPERATOR OF A WORK VEHICLE BASED ON A COMPONENT OF THE VEHICLE BEING CONTROLLED

FIELD OF THE INVENTION

The present disclosure generally relates to work vehicles and, more particularly, to systems and methods for providing haptic feedback to an operator of a work vehicle via an operator control device based on a component of the vehicle being controlled by the operator control device.

BACKGROUND OF THE INVENTION

Work vehicles, such construction or agricultural vehicles, include a variety of components that may be controlled when performing a work operation (e.g. a construction or agricultural operation). For example, such components may include the engine, the transmission, the work implement(s), and/or the like. In this regard, a work vehicle generally includes various operator control devices (e.g., joysticks, levers, and/or the like) positioned with its cab. Each operator control device is typically configured to receive an operator input for controlling the operation of one of the components of the work vehicle. Given the number of components that may be controlled by the operator in a modern work vehicle, the typical cab may include several operator control devices. Such cabs may feel cluttered. Moreover, work vehicles having numerous operator control devices may be difficult to operate, thereby increasing the skill level necessary to operate the vehicle.

However, the use of a single operator control device to control multiple components of the work vehicle has certain drawbacks. Generally, each operator control device in a work vehicle provides a unique haptic response (e.g., resistance to movement by the operator, range of motion, detents, and/or the like). As such, operators may associate a particular haptic response with the control of a particular component of the work vehicle. For example, an operator may associate one haptic response with controlling the engine and a different haptic response with controlling the work implement. The differing haptic responses may allow the work vehicle operator to determine which component he/she is controlling by feel.

Accordingly, an improved system and method for providing haptic feedback to an operator of a work vehicle that overcomes one or more issues in the prior art would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a system for providing haptic feedback to an operator of a work vehicle. The system may include an operator control device configured to receive an operator input associated with controlling the operation of a selected component of the work vehicle, with the operator control device further configured to provide a haptic response to the operator when the operator provides the operator input to the operator control device. The system may also include a controller communicatively coupled to the operator control device. The controller may be configured to identify one of a first component of the work vehicle or a second component of the work vehicle as the selected component to be controlled via the operator control device. Furthermore, the controller may be configured to control the operation of the operator control device such that the operator control device provides a first haptic response to the operator when first component is identified as the selected component. Additionally, the controller may be configured to control the operation of the operator control device such that the operator control device provides a second haptic response to the operator when second component is identified as the selected component, the second haptic response differing from the first haptic response.

In another aspect, the present subject matter is directed to a method for providing haptic feedback to an operator of a work vehicle. The work vehicle may include an operator control device configured to provide a haptic response to the operator when the operator provides an operator input to the operator control device. The method may include identifying, with one or more computing devices, one of a first component of the work vehicle or a second component of the work vehicle as a selected component of the work vehicle to be controlled via the operator control device. Furthermore, when the first component is identified as the selected component, the method may include controlling, with the one or more computing devices, the operation of the operator control device such that the operator control device provides a first haptic response to the operator. Additionally, when the second component is identified as the selected component, the method may include controlling, with the one or more computing devices, the operation of the operator control device such that the operator control device provides a second haptic response to the operator, the second haptic response differing from the first haptic response.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
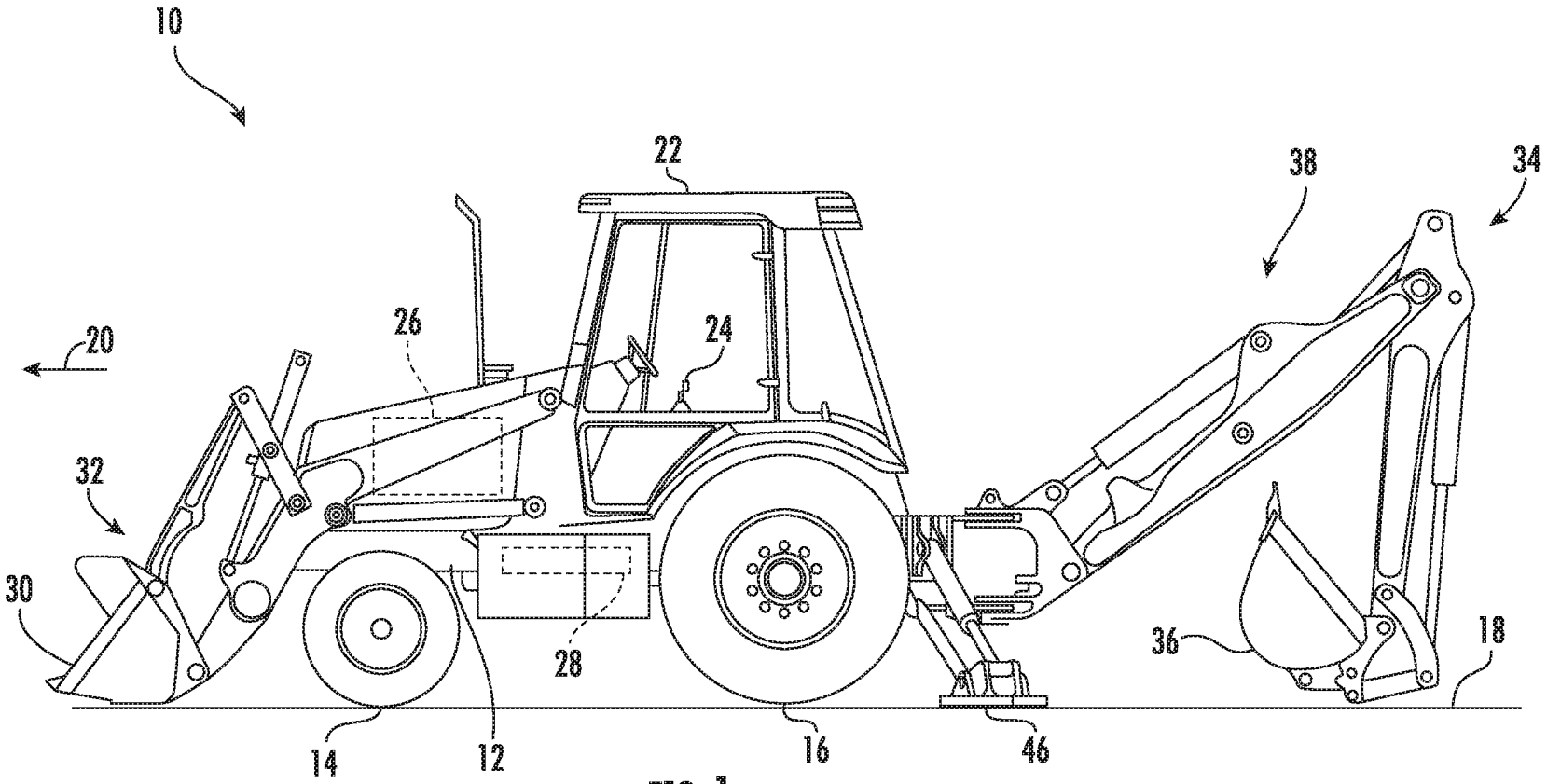
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for providing haptic feedback to an operator of a work vehicle. Specifically, in several embodiments, a controller of the disclosed system may be configured to identify one of a first component of the work vehicle or a second component of the vehicle as a selected component to be controlled via an operator control device (e.g., a joystick, a lever, and/or the like) of the vehicle. The operator control device may, in turn, be configured to receive an operator input associated with controlling the operation of the selected component of the work vehicle. For example, in one embodiment, the operator control device may be configured to receive operator inputs associated with controlling either the engine of the work vehicle or a work implement (e.g., a bucket, a blade, and/or the like) of the vehicle. In such an embodiment, the operator of the work vehicle may select one of the engine or the work implement (e.g., via a switch, button, knob, or other operator input device) as the selected component (i.e., the component he/she would like to control). Thereafter, the controller may control the operation of the selected component (e.g., the engine or the work implement) based on the operator input received by the operator control device.

In accordance with aspects of the present subject matter, the operator control device may be further configured to provide a haptic response to the operator when the operator provides the operator input to the operator control device. In general, the haptic response may be associated with a resistance to movement of the operator control device by the operator, a range of motion of the operator control device, a detent(s) along the range of motion of the operator control device, and/or the like. Specifically, in several embodiments, the controller may be configured to control the operation of the operator control device such that the operator control device provides a first haptic response when the first component is identified as the selected component and a second, different haptic response when second component is identified as the selected component. For example, in one embodiment, the operator control device may provide a first haptic response (e.g., resistance to movement, range of motion, and/or detent location) when controlling the engine and a second, different haptic response (e.g., resistance to movement, range of motion, and/or detent location) when controlling the work implement. As such, the operator may control multiple components of the work vehicle with a single operator control device, while still receiving a unique haptic response when controlling each component.

Referring now to the drawings, FIG. 1 illustrates a side view of one embodiment of a work vehicle in accordance with aspects of the present subject matter. As shown, the work vehicle 10 is configured as a backhoe loader. However, in other embodiments, the work vehicle 10 may be configured as any other suitable work vehicle known in the art, such as various other construction vehicles (e.g., earth-moving vehicles, loaders, and/or the like) and/or agricultural vehicles (e.g., agricultural tractors, harvesters, self-propelled sprayers, and/or the like).

As shown in FIG. 1, the work vehicle 10 may include a frame or chassis 12 configured to support or couple to a plurality of components. For example, a pair of steerable front wheels 14 (one is shown) and a pair of driven rear wheels 16 (one is shown) may be coupled to the frame 12. The wheels 14, 16 may be configured to support the vehicle 10 relative to a ground surface 18 and move the vehicle 10 along the ground surface 18 in a direction of travel 20. However, in alternative embodiments, the front wheels 14 may be driven in addition to or in lieu of the rear wheels 16. Moreover, in further embodiments, the vehicle 10 may include track assemblies (not shown) in place of the front and/or rear wheels 14, 16. Additionally, an operator's cab 22 may be supported by a portion of the chassis 12 and may house one or more operator control devices 24 (e.g., a joystick(s), a lever(s), and/or the like) for permitting an operator to control the operation of the work vehicle 10. As will be described below, each operator control device 24 may be configured to receive an operator input associated with controlling the operation of a selected component of the work vehicle 10 and provide a haptic response to the operator when receiving the operator input.

Furthermore, the work vehicle 10 may include one or more powertrain components for adjusting the speed at which the vehicle 10 moves in the direction of travel 20. Specifically, in several embodiments, the work vehicle 10 may include an engine 26 and a transmission 28 mounted on the frame 12. In general, the engine 26 may be configured to generate power by combusting or otherwise burning a mixture of air and fuel. The transmission 28 may, in turn, be operably coupled to the engine 26 and may provide variably adjusted gear ratios for transferring the power generated by the engine 26 to the driven wheels 16. For example, increasing the power output by the engine 26 (e.g., by increasing the fuel flow to the engine 26) and/or shifting the transmission 28 into a higher gear may increase the speed at which the vehicle 10 moves in the direction of travel 20. Conversely, decreasing the power output by the engine 26 (e.g., by decreasing the fuel flow to the engine 26) and/or shifting the transmission 28 into a lower gear may decrease the speed at which the vehicle 10 moves in the direction of travel 20.

Additionally, the work vehicle 10 may include one or more work implements. Each work implement may, in turn, be configured to perform a work operation, such as a construction operation (e.g., moving soil, building materials, debris, and/or the like) and/or an agricultural operation (e.g., harvesting, spraying, and/or the like). For example, in the illustrated embodiment, the vehicle 10 includes a loader 30 positioned adjacent to a forward end 32 of the vehicle 10. The loader 30 may, in turn, be configured to transport or otherwise convey a volume of soil or other material (e.g., building materials and debris) relative to the ground surface 18. Furthermore, in the illustrated embodiment, work vehicle 10 includes a backhoe 34 having a bucket 36 at or adjacent to an aft end 38 of the vehicle 10. The backhoe 34 may, in turn, be configured to dig or otherwise excavate a volume of soil or other debris (e.g., building materials and debris). However, in alternative embodiments, the work vehicle 10 may include any other suitable work implement(s), such as blades, rippers, harvesting implements (e.g., headers), spray booms, and/or the like.

Additionally, as shown in FIG. 1, the work vehicle 10 may include a pair of stabilizer legs 46 (one is shown) positioned adjacent to the driven wheels 16. The stabilizer legs 46 may, in turn, be configured to support the weight of the vehicle 10 and the contents of bucket 36 when performing a digging or excavation operation. Furthermore, the stabilizer legs 46 may be pivotably coupled to the frame 12. In this regard, the stabilizer legs 46 may be movable between a lowered position in which the legs 46 contacts the ground surface 18 to support the weight of the vehicle 10 and a raised position in which the legs 46 are lifted off the ground surface 18 to allow the vehicle 10 to move in the direction of travel 20.

It should be further appreciated that the configuration of the work vehicle 10 described above and shown in FIG. 1 is provided only to place the present subject matter in an exemplary field of use. Thus, it should be appreciated that the present subject matter may be readily adaptable to any manner of vehicle configuration.

Figure 2:
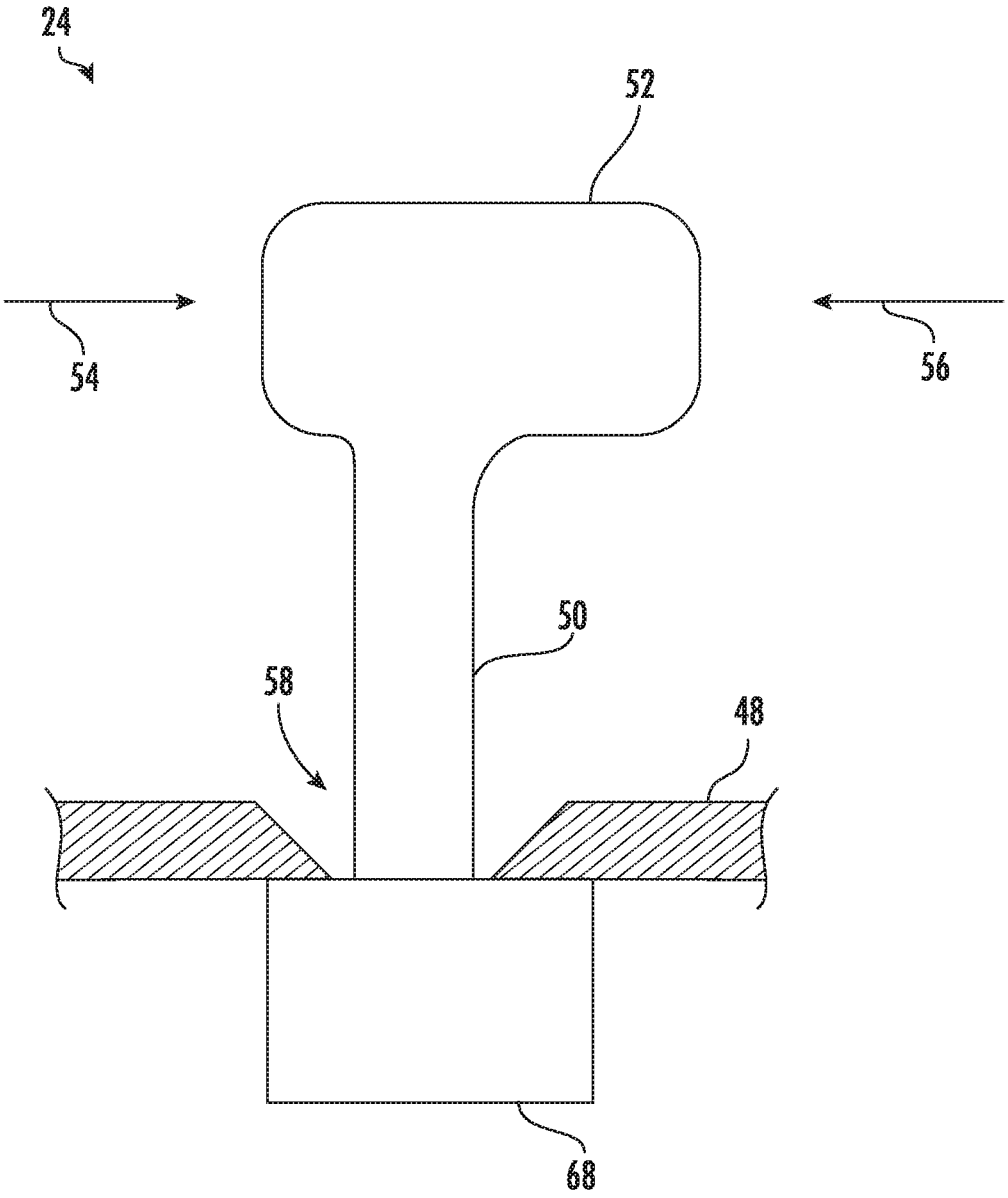
FIG. 2 illustrates a side view of one embodiment of an operator control device suitable for use with a work vehicle in accordance with aspects of the present subject matter.
Figure 3:
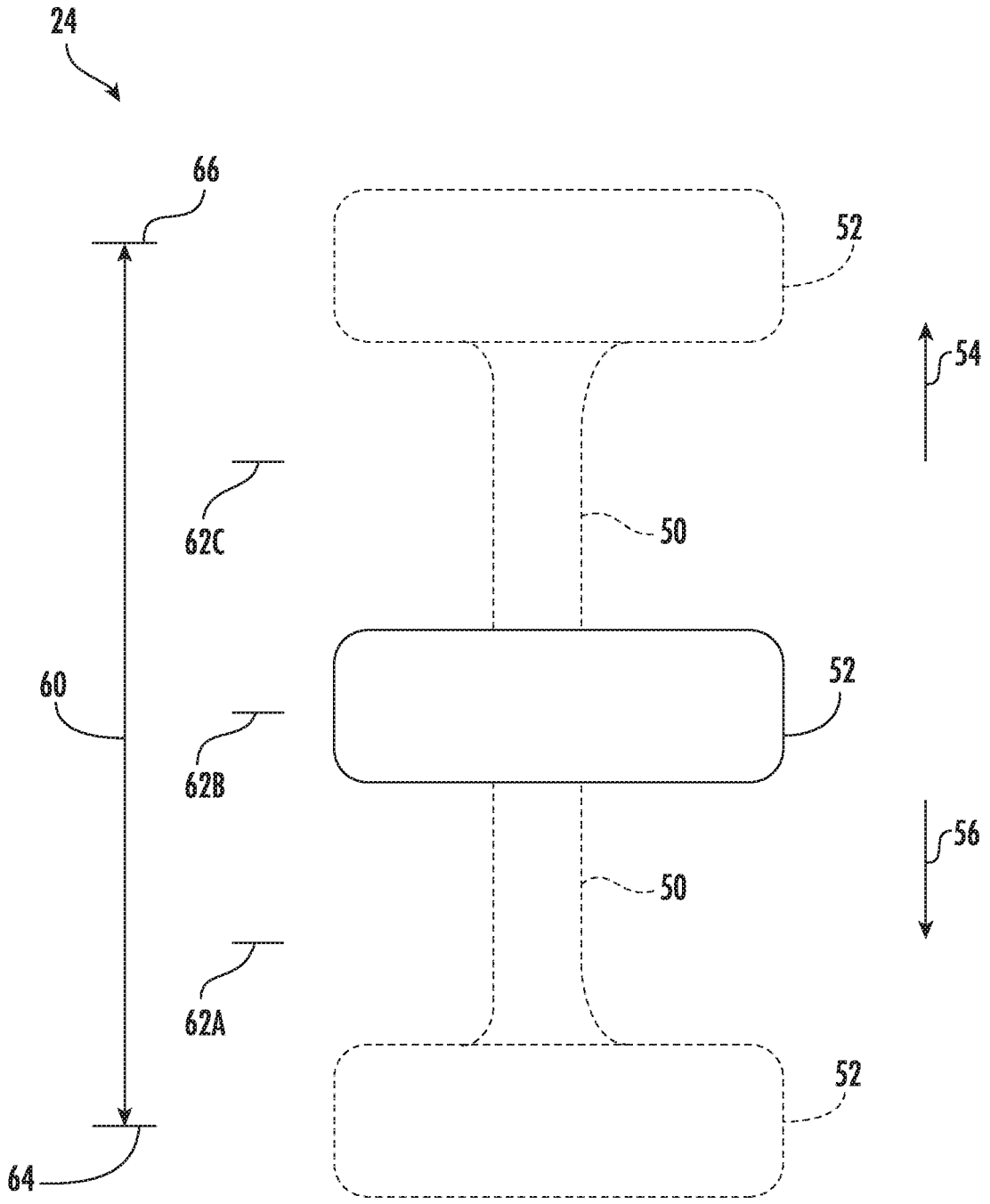
FIG. 3 illustrates a top of the operator control device shown in FIG. 2, particularly illustrating a range of motion of the operator control device.

Referring now to FIGS. 2 and 3, differing views of an operator control device 24 are illustrated in accordance with aspects of the present subject matter. Specifically, FIG. 2 illustrates a side view of one embodiment of the operator control device 24. Additionally, FIG. 3 illustrates a top view of the operator control device 24 shown in FIG. 2, particularly illustrating a range of motion of the operator control device 24.

In several embodiments, the operator control device 24 may be configured to selectively receive one or more operator inputs associated with controlling the operation of a plurality of components of the work vehicle 10. For example, in one embodiment, the operator control device 24 may be configured to selectively receive operator input(s) associated with controlling the operation of a powertrain component (e.g., the engine 26 or the transmission 28) and a work implement (e.g., the loader 30 or the backhoe 34). In another embodiment, the operator control device 24 may be configured to selectively receive operator input(s) associated with the operation of a first work implement (e.g., the loader 30) and a second work implement (e.g., the backhoe 34). However, in alternative embodiments, the operator control device 24 may be configured to selectively receive operator inputs associated with the operation of any other suitable components of the vehicle 10. Moreover, in further embodiments, the operator control device 24 may be configured to selectively receive operator input(s) associated with the operation of any suitable number of vehicle components, such as three or more components. Additionally, as will be described below, a controller may be configured to identify one of the plurality of components capable of being controlled via the operator control device 24 as a selected component (e.g., based on operator input and/or sensor data) such that any operator input(s) received by the operator control device 24 are used to control the operation of the selected component.

The operator control device 24 may correspond to any suitable device or structure configured to receive operator inputs for controlling the operation of the selected component of the vehicle 10. In general, the operator control device may be configured to convert the operator input(s) (e.g., the movement of the operator control device 24) into a signal (e.g., an electric or wireless signal) or other suitable type of data that a controller can interpret. Thereafter, the operator control device 24 may be configured to transmit the signal to the controller for controlling the operation of the selected component. Specifically, in several embodiments, the operator control device 24 may be configured as a joystick. In such embodiments, the operator control device 24 may include a console 48 configured to be mounted within the cab 22 of the vehicle 10. Moreover, the operator control device 24 may include a shaft 50 extending upward relative to the console 48 and a handle 52 mounted on top of the shaft 50. As such, the shaft 50 may support the handle 52 for movement relative to the console 48 to allow the operator of the vehicle 10 to provide operator inputs to the operator control device 24. For example, in one embodiment, the operator may move the handle 52 in a first or forward direction (e.g., as indicated by arrow 54 in FIG. 2) and/or a second or reverse direction (e.g., as indicated by arrow 56 in FIG. 2) relative to the console 48 to provide the operator input(s). Additionally, as shown in FIG. 2, an opening(s) 58 may be defined through the console 48 to permit the shaft 50, electrical wires, and/or other components to extend through the console 48. However, in alternative embodiments, the operator control device 24 may be configured as any other suitable device for receiving operator input(s) for controlling the selected component of the vehicle 10, such as a lever.

Referring now to FIG. 3, the operator control device 24 may be configured to provide one or more haptic responses to the operator of the vehicle 10. As used herein, a "haptic response" may be any response associated with the operator's sense of touch that the operator control device 24 provides to the operator when the operator provides the operator input(s) (e.g., moves the operator control device 24). Specifically, in several embodiments, the haptic response(s) provided by the operator control device 24 may be associated with a resistance to movement of the operator control device 24, a range of motion (e.g., as indicated by arrow 60 in FIG. 3) of the operator control device 24, and/or one or more detents (e.g., as indicated by lines 62A, 62B, 62C in FIG. 3) located along the range of motion 60 of the operator control device 24. However, in alternative embodiments, the haptic response(s) provided by the operator control device 24 may correspond to any other suitable response(s) associated with the operator's sense of touch, such as vibrations.

As indicated above, in several embodiments, the haptic response(s) provided by the operator control device 24 may be associated with a resistance to movement of the operator control device 24 by the operator. For example, in such embodiments, when the operator moves the operator control device 24 in one of the forward or reverse directions 54, 56, the operator may feel a resistance or a force acting on the handle 52 in the opposite direction. Such a resistance to movement may prevent the operator from inadvertently moving the operator control device 24 too far along its range of motion 60 and/or moving the operator control device 24 too quickly, thereby minimizing operator input(s) that may result in excessive and/or abrupt changes to the operating parameter(s) of the selected component of the vehicle 10.

Furthermore, as indicated above, in several embodiments, the haptic response(s) provided by the operator control device 24 may be associated with the range of motion 60 along which the operator may move the operator control device 24. In one embodiment, the handle 52 may be movable between a first or rearmost position (e.g., as indicated by line 64 in FIG. 3) and a second or forward-most position (e.g., as indicated by line 66 in FIG. 3). In this regard, the operator may move the handle 52 between the rearmost and forward-most positions to vary an operating parameter(s) of the selected component of the vehicle 10. For example, as illustrated in FIG. 3, the handle 52 is positioned centrally between the rearmost and forward-most positions of the range of motion 60. As such, the operator may move the handle 52 in the forward direction 54 to increase the value(s) of the operating parameter(s) of the selected component (e.g., increase the ground speed of the vehicle 10). Thus, the operating parameter(s) of the selected component may be at its maximum value(s) when the handle is at the forward-most position 66 of the range of motion 60. For purposes of illustration, FIG. 3 shows the handle 52 at the forward-most position 66 in dashed lines. Conversely, the operator may move the handle in the reverse direction 56 to decrease the value(s) of the operating parameter(s) of the selected component (e.g., decrease the ground speed of the vehicle 10). As such, the operating parameter(s) of the selected component may be at its minimum value(s) when the handle 52 is at the rearmost position 64 of the range of motion 60. For purposes of illustration, FIG. 3 shows the handle 52 at the rear-most position 64 in dashed lines. However, in alternative embodiments, the operating parameter(s) of the selected component may be varied in any other suitable manner when the operator moves the operator control device 24 along the range of motion 60.

Moreover, as indicated above, in several embodiments, the haptic response(s) provided by the operator control device 24 may associated with one or more detents along the range of motion 60. In general, the detent(s) may provide the operator with the feel of increments of movement along the range of motion 60 of the handle 52. For example, the detent(s) may have the feel of notches or catches that temporarily stop or slow the movement of the handle 52 at certain positions along the range of motion 60. As such, the detent(s) may be located at predetermined locations along the range of motion 60 that are associated with certain operating parameter values of the selected component of the vehicle 10. As mentioned above, in one embodiment, the operating parameter(s) of the selected component may be at its minimum value(s) when the handle 52 is at the rearmost position 64 and at its maximum value(s) when the handle 52 is at the forward-most position 66. In this regard, as shown in FIG. 3, in the illustrated embodiment, three detents 62A, 62B, 62C are provided along the range of motion 60 of the handle 52, with the detents 62A, 62B, 62C being evenly spaced apart between the rearmost and forward-most positions 64, 66. In such an embodiment, the operating parameter values of the selected component of the vehicle 10 may be at zero percent of the maximum value when the handle 52 is at the rear-most position 64, twenty-five percent of the maximum value when the handle 52 is at the detent 62A, fifty percent of the maximum value when the handle 52 is at the detent 62B, seventy-five percent of the maximum value when the handle 52 is at the detent 62C, and one hundred percent of the maximum value when the handle 52 is at the forward-most position 66. However, in alternative embodiments, the haptic response(s) provided by the operator control device 24 may include any other suitable number and/or location of detents.

Referring again to FIG. 2, the operator control device 24 may include a haptic response actuator 68 configured to provide the haptic response(s) to the operator of the vehicle 10. Specifically, in several embodiments, the haptic response actuator 68 may be coupled to the shaft 50. As such, the haptic response actuator 68 may be configured to apply a force to the shaft 50 and handle 52, such as when the haptic response(s) is associated with a resistance to movement of the handle 52 and/or a detent(s). Additionally, the haptic response actuator 68 may be configured to circumscribe or otherwise control the range of motion 60 of the handle 52. However, in alternative embodiments, the haptic response actuator 68 may be configured to interact with the shaft 50 and handle 52 in any other suitable manner that provides the desired haptic response(s).

The haptic response actuator 68 may correspond to any suitable device that is configured to provide the haptic response(s) to the vehicle operator. Specifically, in several embodiments, the haptic response actuator 68 may include first and second fluid chambers that are fluidly coupled together via a fluid passage having a smaller cross-sectional diameter than the fluid chambers. In this regard, when the operator moves the handle 52 along the range of motion 60, fluid is forced from one of the fluid chambers into the other fluid chamber, with the fluid passage providing a resistance to the transfer of fluid between the chambers. The resistance may, in turn, provide the resistance to movement of the handle 52 by the operator. Furthermore, by selectively adjusting the viscosity of the fluid within the actuator 68 (e.g., via the use of a magneto-rheological fluid) and/or the diameter of the fluid passage (e.g., via a suitable control valve), such resistance may be varied. Varying the resistance may also provide the detents along the range of motion 60 of the handle 52. Additionally, by selectively permitting and occluding flow through the fluid passage, the range of motion 60 of the handle 52 may be defined. As will be described below, the haptic response actuator 60 may be controlled in a manner that varies the haptic response(s) of the operator control device 24 based on the selected component of the vehicle 10. However, in alternative embodiments, the haptic response actuator 68 may correspond to any other suitable device(s), such as a solenoid(s), an electric motor(s), and/or the like.

It should be further appreciated that the configuration of the operator control device 24 described above and shown in FIGS. 2 and 3 is provided only to place the present subject matter in an exemplary field of use. Thus, it should be appreciated that the present subject matter may be readily adaptable to any manner of operator control device configuration.

Figure 4:
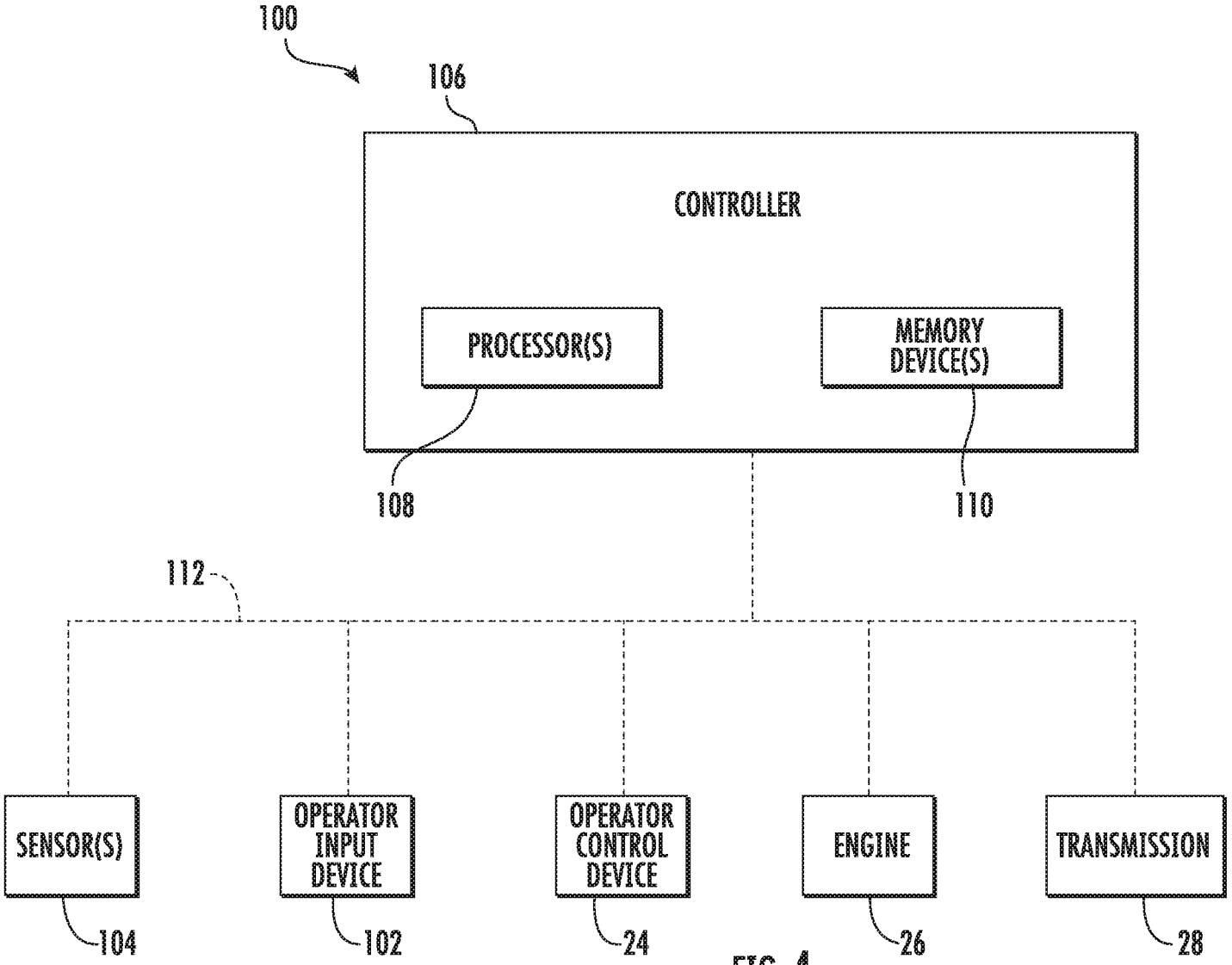
FIG. 4 illustrates a schematic view of one embodiment of a system for providing haptic feedback to an operator of a work vehicle in accordance with aspects of the present subject matter.

Referring now to FIG. 4, a schematic view of one embodiment of a system 100 for providing haptic feedback to an operator of a work vehicle is illustrated in accordance with aspects of the present subject matter. In general, the system 100 will be described herein with reference to the work vehicle 10 and the operator control device 24 described above with reference to FIGS. 1-3. However, it should be appreciated by those of ordinary skill in the art that the disclosed system 100 may generally be utilized with work vehicles having any suitable vehicle configuration and/or operator control devices having any suitable device configuration.

As shown in FIG. 4, the system 100 may include an operator input device 102 configured to receive an operator input indicative of the selected component of the work vehicle 10. In this regard, the operator input device 102 may correspond to any suitable device that allows the operator of the vehicle 10 to select which component he/she would like to control with the operator control device 24. For example, the operator input device 102 may be configured as a switch having a first position and a second position. As such, the operator may use the operator control device 24 to control a first component (e.g., a powertrain component) of the work vehicle 10 when the switch is in the first position and a second component (e.g., a work implement) of the vehicle 10 when the switch is in the second position. However, in alternative embodiments, the operator input device 102 may correspond to any other suitable device(s) for receiving an operator input(s) associated with the selected component of the vehicle 10, such as a knob(s), a button(s), a dial(s), and/or the like. Moreover, in one embodiment, the operator input device 102 may be positioned on the operator control device 24 (e.g., on the handle 52) to permit the operator to easily select and/or switch the selected component of the work vehicle 10. However, in other embodiments, the operator input device 102 may be positioned at any other suitable location within the cab 22.

Furthermore, the system 100 may include one or more sensors 104, with each sensor 104 configured to detect an operating parameter of the work vehicle 10 that is indicative of the selected component of the vehicle 10. For example, in one embodiment, the sensor(s) 104 may be configured to detect the position of the stabilizer legs 46 relative to the ground surface 18. Specifically, as indicated above, the stabilizer legs 46 may generally be in the lowered position such that the legs 46 contacts the ground surface 18 when the operator is using the backhoe 34. Conversely, when the stabilizer legs 46 are in the raised position such that the legs 46 are lifted off the ground surface 18, the vehicle 10 may be traveling across the ground surface 18 in the direction of travel 20. As such, when the sensor(s) 104 detects that the stabilizer legs 46 are in the lowered position, the selected component of the work vehicle 10 may correspond to the backhoe 34. However, when the sensor(s) 104 detects that the stabilizer legs 46 are in the raised position, the selected component of the work vehicle 10 may correspond to a powertrain component (e.g., the engine 26). However, in alternative embodiments, the sensor(s) 104 may be configured to detect any other suitable operating parameter(s) of the vehicle 10 that is indicative of the selected component to be controlled by the operator control device 24.

In accordance with aspects of the present subject matter, the system 100 may include a controller 106 positioned on and/or within or otherwise associated with the vehicle 10. In general, the controller 106 may comprise any suitable processor-based device known in the art, such as a computing device or any suitable combination of computing devices. Thus, in several embodiments, the controller 106 may include one or more processor(s) 108 and associated memory device(s) 110 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 110 of the controller 106 may generally comprise memory element(s) including, but not limited to, a computer readable medium (e.g., random access memory (RAM)), a computer readable non-volatile medium (e.g., a flash memory), a floppy disc, a compact disc-read only memory (CD-ROM), a magneto-optical disc (MOD), a digital versatile disc (DVD), and/or other suitable memory elements. Such memory device(s) 110 may generally be configured to store suitable computer-readable instructions that, when implemented by the processor(s) 108 configure the controller 106 to perform various computer-implemented functions.

In addition, the controller 106 may also include various other suitable components, such as a communications circuit or module, a network interface, one or more input/output channels, a data/control bus and/or the like, to allow controller 106 to be communicatively coupled to any of the various other system components described herein (e.g., the operator control device 24, the engine 26, the transmission 28, the operator input device 102, and/or the sensor(s) 104). For instance, as shown in FIG. 4, a communicative link or interface 112 (e.g., a data bus) may be provided between the controller 106 and the components 24, 26, 28, 102, 104 to allow the controller 106 to communicate with such components 24, 26, 28, 102, 104 via any suitable communications protocol (e.g., CANBUS).

The controller 106 may correspond to an existing controller(s) of the vehicle 10, itself, or the controller 106 may correspond to a separate processing device. For instance, in one embodiment, the controller 106 may form all or part of a separate plug-in module that may be installed in association with the vehicle 10 to allow for the disclosed systems to be implemented without requiring additional software to be uploaded onto existing control devices of the vehicle 10. It should also be appreciated that the functions of the controller 106 may be performed by a single processor-based device or may be distributed across any number of processor-based devices, in which instance such devices may be considered to form part of the controller 106. For instance, the functions of the controller 106 may be distributed across multiple application-specific controllers, such as an engine controller, a transmission controller, work implement controller, and/or the like.

In several embodiments, the controller 106 may be configured to identify a selected component of the work vehicle 10 to be controlled via an operator control device of the vehicle 10. As described above, the operator control device 24 may be configured to selectively receive one or more operator inputs associated with controlling the operation of first and second components of the vehicle 10. In one embodiment, the first vehicle component may correspond to a powertrain component (e.g., the engine 26, the transmission 28, and/or the like) of the vehicle 10, while the second vehicle component may correspond to a work implement (e.g., the loader 30, the backhoe 34, and/or the like) of the vehicle 10. In another embodiment, the first vehicle component may correspond to a first work implement (e.g., one of the loader 30 or the backhoe 34) of the vehicle 10, while the second vehicle component may correspond to a second work implement (e.g., the other of the loader 30 or the backhoe 34). As such, the selected component of the vehicle 10 may generally correspond to which one of the first or second vehicle components that the operator would like to control with the operator control device 24. In this regard, the controller 106 may be configured to receive data indicative of the selected component of the vehicle 10 from the operator input device 102 and/or the sensor(s) 104 (e.g., via the communicative link 112). Thereafter, the controller 106 may be configured to process/analyze the received data to identify one of the first or second vehicle components as the selected component. For instance, the controller 106 may include a look-up table(s), suitable mathematical formula, and/or algorithms stored within its memory 110 that correlates the received data to the selected component. In alternative embodiments, the controller 106 may be configured to one of any suitable number of components, such as three or more components, as the selected component.

In accordance with aspects of the present subject matter, the controller 106 may be configured to control the operation of the operator control device such that the haptic response provided by the operator control device is based on the selected component. Specifically, as described above, when the first component is identified as the selected component, the controller 106 may control the operation of the haptic response actuator 68 of the operator control device 24 such that the operator control device 24 provides a first haptic response to the operator. In this regard, when the operator provides an operator input(s) to the operator control device 24 for controlling the operation of the first component (i.e., the first component is the selected component), the operator control device 24 may provide a haptic response associated with the first component to the operator. Conversely, when the second component is identified as the selected component, the controller 106 may control the operation of the haptic response actuator 68 of the operator control device 24 such that the operator control device 24 provides a second, different haptic response to the operator. As such, when the operator provides an operator input(s) to the operator control device 24 for controlling the operation of the second component (i.e., the second component is the selected component), the operator control device 24 may provide a haptic response associated with the second component to the operator. Thus, the operator may be able to control a plurality of components of the work vehicle 10 with a single operator control device, while still experiencing different haptic responses when controlling each vehicle component.

As described above, the operator control device 24 may be configured to provide various types of haptic responses to the operator. Specifically, in several embodiments, the haptic responses may be associated with a resistance to movement of the operator control device 24 by the operator. For example, the first haptic response may be a first resistance to movement, while the second haptic response may be a second, different resistance to movement. As such, the operator may feel a first force acting in the opposite direction to which the operator is moving the handle 52 when controlling the first component. Moreover, the operator may feel a second, different force acting in the opposite direction to which the operator is moving the handle 52 when controlling the second component. In such embodiments, the operator may be able to determine which of the first or second components is the selected component based on the resistance he/she is feeling when providing the operator input(s) to the operator control device 24.

Figure 5:
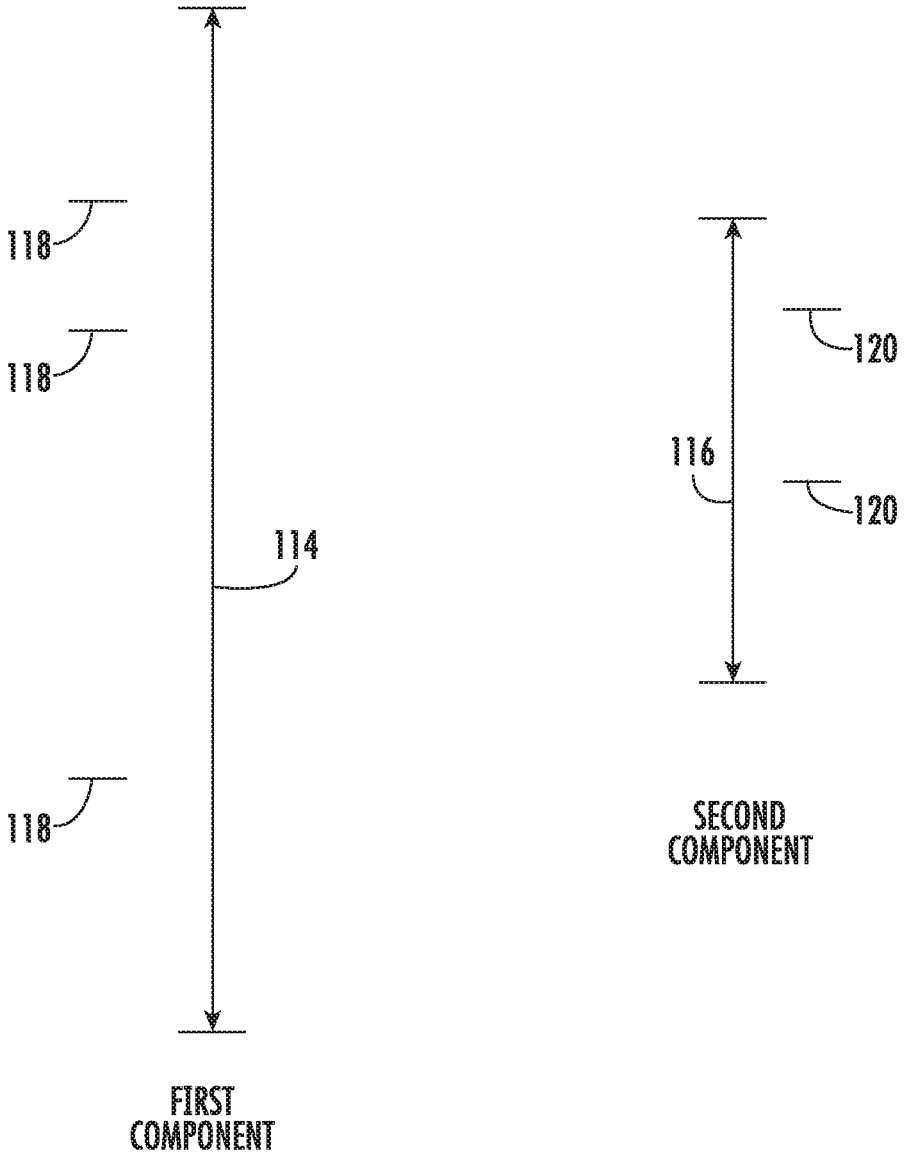
FIG. 5 illustrates a graphical view of a first haptic response provided by an operator control device when the vehicle operator is controlling a first component of a work vehicle and second haptic response provided by the operator control device when the operator is controlling a second component of the work vehicle in accordance with aspects of the present subject matter.

Furthermore, the haptic responses may be associated with the range of motion of the operator control device 24. In several embodiments, the first haptic response may be a first range of motion, while the second haptic response may be a second, different range of motion. For example, as shown in FIG. 5, in one embodiment, the operator may be able to move the handle 52 along a first range of motion (e.g., as indicated by arrow 114 in FIG. 5) when controlling the first component. Moreover, as shown in FIG. 5, the operator may be able to move the handle 52 along a second, shorter range of motion (e.g., as indicated by arrow 116 in FIG. 5) when controlling the second component. In such embodiments, the operator may be able to determine which of the first or second components is the selected component based on the range of motion that he/she is able to move the operator control device 24 when providing the operator input(s) thereto.

Additionally, the haptic responses may be associated with one or more detents along the range of motion of the operator control device 24. In several embodiments, the first haptic response may be a first number and/or positioning of detents along the range of motion of the operator control device 24. Conversely, the second haptic response may be a second, different number and/or positioning of detents along the range of motion of the operator control device 24. For example, as shown in FIG. 5, the operator may feel three detents (e.g., as indicated by lines 118 in FIG. 5) at certain positions along the range of motion of the operator control device 24 when controlling the operation of the first component. However, when controlling the operation of the second component, the operator may feel two detents (e.g., as indicated by lines 120 in FIG. 5) at different locations along the range of motion of the operator control device 24.

It should be appreciated that, although specific types of haptic responses (i.e., resistance to movement, range of motion, and detents) are described above, the first and second haptic responses may correspond to any other suitable responses that the operator may feel when providing the operator input(s) to the operator control device.

Figure 6:
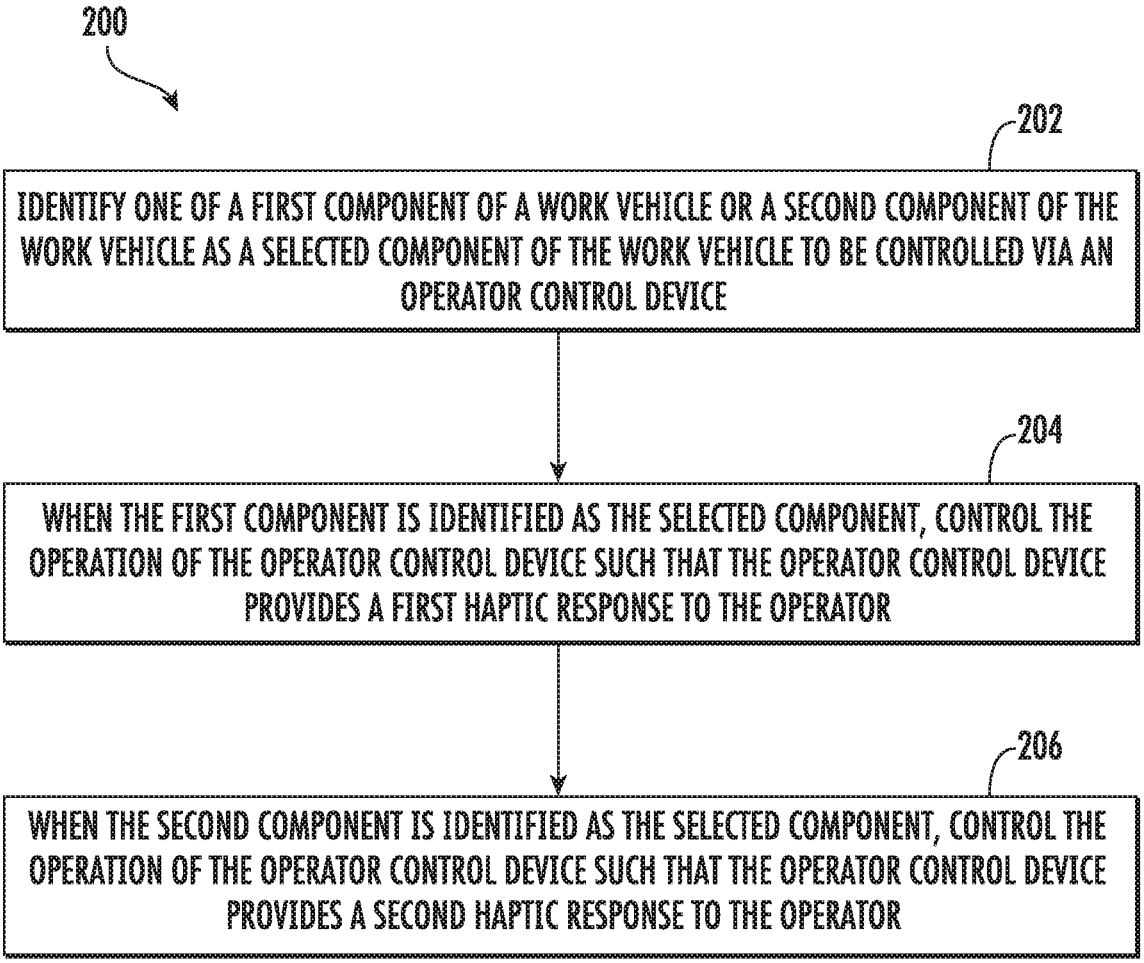
FIG. 6 illustrates a flow diagram of one embodiment of a method for providing haptic feedback to an operator of a work vehicle in accordance with aspects of the present subject matter.

Referring now to FIG. 6, a flow diagram of one embodiment of a method 200 for providing haptic feedback to an operator of a work vehicle is illustrated in accordance with aspects of the present subject matter. In general, the method 200 will be described herein with reference to the work vehicle 10, the operator control device 24, and the system 100 described above with reference to FIGS. 1-5. However, it should be appreciated by those of ordinary skill in the art that the disclosed method 200 may generally be implemented with any work vehicle having any suitable vehicle configuration, any operator control device having any suitable device configuration, and/or any system having any suitable system configuration. In addition, although FIG. 6 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 6, at (202), the method 200 may include identifying, with one or more computing devices, one of a first component of a work vehicle or a second component of the work vehicle as a selected component of the work vehicle to be controlled via an operator control device. For instance, as described above, the controller 106 may be configured to identify one of a first component (e.g., the engine 26) or a second component (e.g., the backhoe 34) of the work vehicle 10 as a selected component of the vehicle 10 to be controlled via the operator control device 24.

Additionally, at (204), when the first component is identified as the selected component, the method 200 may include, controlling, with the one or more computing devices, the operation of the operator control device such that the operator control device provides a first haptic response to the operator. For instance, as described above, when the first component is identified as the selected component, the controller 106 may be configured to control the operation of the operator control device 24 (e.g., the haptic response actuator 68 of the operator control device 24) such that the operator control device 24 provides a first haptic response (e.g., resistance to movement, range of motion, and detents) to the operator.

Moreover, as shown in FIG. 6, at (206), when the second component is identified as the selected component, the method 200 may include controlling, with the one or more computing devices, the operation of the operator control device such that the operator control device provides a second haptic response to the operator. For instance, as described above, when the second component is identified as the selected component, the controller 106 may be configured to control the operation of the operator control device 24 (e.g., the haptic response actuator 68 of the operator control device 24) such that the operator control device 24 provides a second, different haptic response (e.g., resistance to movement, range of motion, and detents) to the operator.

It is to be understood that the steps of the method 200 are performed by the controller 106 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the controller 106 described herein, such as the method 200, is implemented in software code or instructions which are tangibly stored on a tangible computer readable medium. The controller 106 loads the software code or instructions via a direct interface with the computer readable medium or via a wired and/or wireless network. Upon loading and executing such software code or instructions by the controller 106, the controller 106 may perform any of the functionality of the controller 106 described herein, including any steps of the method 200 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A system for providing haptic feedback to an operator of a work vehicle, the system comprising:

an operator control device configured to receive an operator input associated with controlling an operation of a selected component of the work vehicle, the operator control device further configured to provide a haptic response to the operator when the operator provides the operator input to the operator control device; and a controller communicatively coupled to the operator control device, the controller configured to:

identify one of a first component of the work vehicle or a second component of the work vehicle as the selected component to be controlled via the operator control device;

control an operation of the operator control device such that the operator control device provides a first haptic response to the operator when the first component is identified as the selected component; and control the operation of the operator control device such that the operator control device provides a second haptic response to the operator when the second component is identified as the selected component, the second haptic response differing from the first haptic response, wherein the haptic response is associated with a range of motion of the operator control device, wherein the first haptic response is associated a first range of motion, and wherein the second haptic response being associated a second range of motion.

2. The system of claim 1, further comprising:

an operator input device configured to receive an operator input indicative of the selected component of the work vehicle.

3. The system of claim 1, further comprising:

a sensor configured to detect an operating parameter of the work vehicle that is indicative of the selected component of the work vehicle.

4. The system of claim 1, wherein the first component comprises a powertrain component of the work vehicle and the second component comprises a work implement of the work vehicle.

5. The system of claim 1, wherein the first component comprises a first work implement of the work vehicle and the second component comprises a second work implement of the work vehicle.

6. The system of claim 1, wherein the haptic response is associated with a resistance to movement of the operator control device by the operator, the first haptic response being associated with a first resistance, and the second haptic response being associated with a second resistance.

7. The system of claim 1, wherein the operator control device comprises a joystick.

8. A system for providing haptic feedback to an operator of a work vehicle, the system comprising:

an operator control device configured to receive an operator input associated with controlling an operation of a selected component of the work vehicle, the operator control device further configured to provide a haptic response to the operator when the operator provides the operator input to the operator control device; and a controller communicatively coupled to the operator control device, the controller configured to:

identify one of a first component of the work vehicle or a second component of the work vehicle as the selected component to be controlled via the operator control device;

control an operation of the operator control device such that the operator control device provides a first haptic response to the operator when the first component is identified as the selected component; and control the operation of the operator control device such that the operator control device provides a second haptic response to the operator when the second component is identified as the selected component, the second haptic response differing from the first haptic response, wherein the haptic response is associated with a detent point along a range of motion of the operator control device, wherein the first haptic response is associated with locating the detent point at a first location along the range of motion, and wherein the second haptic response is associated with locating the detent point at a second location along the range of motion.

9. A method for providing haptic feedback to an operator of a work vehicle, the work vehicle including an operator control device configured to provide a haptic response to the operator when the operator provides an operator input to the operator control device, the method comprising:

identifying, with one or more computing devices, one of a first component of the work vehicle or a second component of the work vehicle as a selected component of the work vehicle to be controlled via the operator control device;

when the first component is identified as the selected component, controlling, with the one or more computing devices, an operation of the operator control device such that the operator control device provides a first haptic response to the operator; and when the second component is identified as the selected component, controlling, with the one or more computing devices, the operation of the operator control device such that the operator control device provides a second haptic response to the operator, the second haptic response differing from the first haptic response, wherein the haptic response is associated with a range of motion of the operator control device, wherein the first haptic response is associated with a first range of motion, and wherein the second haptic response is associated with a second range of motion.

10. The method of claim 9, further comprising:

receiving, with the one or more computing devices, an operator input indicative of the selected component of the work vehicle.

11. The method of claim 9, further comprising:

receiving, with the one or more computing devices, sensor data indicative of the selected component of the work vehicle.

12. The method of claim 9, wherein the first component comprises a powertrain component of the work vehicle and the second component comprises a work implement of the work vehicle.

13. The method of claim 9, wherein the first component comprises a first work implement of the work vehicle and the second component comprises a second work implement of the work vehicle.

14. The method of claim 9, wherein the haptic response is associated with providing a resistance to movement of the operator control device by the operator, the first haptic response being associated with a first resistance, and the second haptic response being associated with a second resistance.

15. The method of claim 9, wherein the haptic response is associated with a detent point along a range of motion of the operator control device, the first haptic response being associated with locating the detent point at a first location along the range of motion, and the second haptic response being associated with locating the detent point at a second location along the range of motion.

16. The method of claim 9, wherein the operator control device comprises a joystick.

* * * * *